United States Patent [19]

Guery et al.

[11] 4,253,076

[45] Feb. 24, 1981

[54] CONTACTOR FOR CONTROL OF HIGH CURRENTS

[75] Inventors: Jean-Pierre Guery; Jean-Pierre Lacour, both of Poissy, France

[73] Assignee: La Telemec Anique Electrique, France

[21] Appl. No.: 4,771

[22] Filed: Jan. 19, 1979

[30] Foreign Application Priority Data

Jan. 19, 1978 [FR] France ..... 78 02105

[51] Int. Cl.[3] ..... H01H 50/04

[52] U.S. Cl. ..... 335/132; 335/202

[58] Field of Search ..... 335/132, 202

[56] References Cited

U.S. PATENT DOCUMENTS

| | | | |
|---|---|---|---|
| 3,753,177 | 8/1973 | Grunert et al. | 335/132 |
| 3,964,006 | 6/1976 | Lacan | 335/132 |
| 4,009,457 | 2/1977 | Guery et al. | 335/132 |
| 4,100,517 | 7/1978 | Rodolfi | 335/132 |

*Primary Examiner*—Harold Broome

*Attorney, Agent, or Firm*—William A. Drucker

[57] ABSTRACT

A contactor has a body constituted by a base common to two parallel walls each having on its internal face a rib to guide fixed elements of a removable electro-magnet having means to cooperate with the ribs. The fixed elements form a slide having resilient locking means cooperating with stop means on an adjacent wall such that, in a first position, the core is disposed opposite the armature, the core being assembled to the body by first support members, and the winding being secured to the body by its own independent support members. In a second position, the core remains engaged with the body and extends from the body so that the winding support means are freed from the rib, and the winding can be separated from the core.

8 Claims, 6 Drawing Figures

CONTACTOR FOR CONTROL OF HIGH CURRENTS

BACKGROUND OF THE INVENTION

The invention relates to a contactor in which the body is constituted by a common base connected to two parallel shaped metallic walls each having on its internal surface a rib serving to guide and support the fixed elements of a removable electro-magnet which is provided with members adapted to cooperate with the said ribs, and which attracts a movable armature. Such a contactor which is particularly adapted to the control of polyphase circuits in which high currents circulate is known from French Pat. No. 2284971.

When the fixed elements of the electro-magnet have a certain dissymetry with respect to the body, for example when the winding comprises an auxiliary contact or lateral coupling terminals, it is necessary to avoid that its positioning is carried out in an incorrect manner; furthermore, it is recommended to arrange things such that the heaviest of the fixed elements, in this case the core of the electro-magnet, remain engaged with the body in the position where the winding can already be separated; finally, it is important to establish for each of the elements methods of engagement on the body which shall be distinct, according to whether these latter will be submitted, or not, to blows.

SUMMARY OF THE INVENTION

According to the invention, the principal result sought is achieved by reason of the fact that the said fixed elements assume, once they have been assembled, the form of a slide of which at least one lateral region is provided with resilient locking means cooperating with stop means disposed on a neighbouring wall in such a manner that for a first position of cooperation between these means the core shall be disposed opposite to the armature and shall be assembled to the body by first support members, whilst the winding is secured with the body by its own support members independent from those of the core, and that, for a second position of cooperation between these means, the core remains engaged with the body and extends at the exterior from the latter to an extent such that, on the one hand, the support means appertaining to the winding shall be freed from the rib and that, on the other hand, the winding can be separated from the core on which it is placed.

BRIEF DESCRIPTION OF THE DRAWINGS

Other features of the invention will appear better in the following description, which is accompanied by the following figures.

DESCRIPTION OF THE PREFERRED EMBODIMENT

Figure 1:
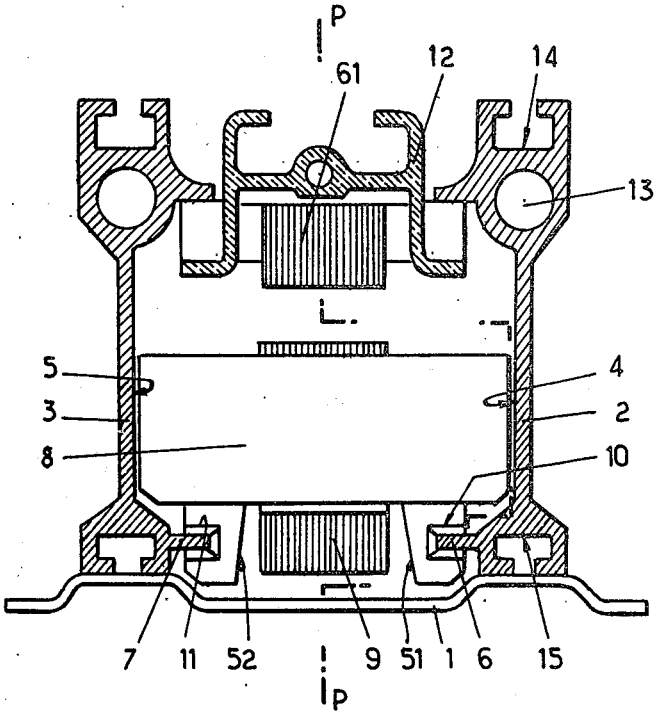
FIG. 1 shows a view in partial section from the side of the body of the apparatus in which there are mounted the winding, a divided portion of the core and the armature.

A contactor body, such as is shown in FIG. 1, comprises principally a common metallic base 1 intended to be fixed on a support or a wall, two parallel shaped metal wings 2 and 3 secured to the base by means not shown but cooperating with lower grooves such as 15, a fixed electro-magnet having a core 9 and an excitation winding 8 which is associated therewith, as well as a movable armature 16 fast to a shaped element 12 to which will be coupled means for the operation of contacts, not shown, but of which the casings will be fixed on the shaped walls with the aid of upper grooves 14; the movement of the armature could be guided, for example, by levers not shown which would be pivoted in cylindrical housings of the walls, shown at 13.

The envelope of the winding 8, which is advantageously constituted by a moulded member enclosing the elements of the winding, comprises two support means for coupling it to the body; these means are constituted by two slideways 51 and 52 (see FIGS. 1, 2 and 3) each having a respective groove 10 or 11; these two grooves have a position and a shape which permits them to engage and to slide along two respective ribs 6 and 7, disposed on the opposed internal faces 4 and 5, appertaining respectively to the wings 2 and 3 being parallel to the base 1. These ribs will advantageously be formed during the manufacture of the wing by a process of extrusion, and accordingly will likewise be parallel to the grooves 14 and the housing 13. The winding is thus guided and supported in axial position in the body by its slideways.

Figure 2:
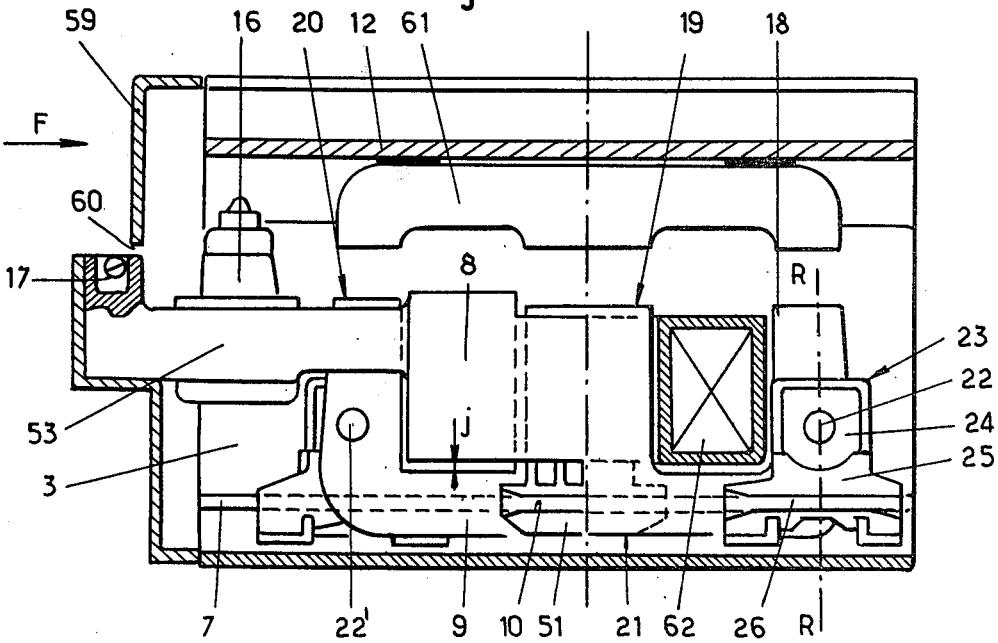
FIG. 2 illustrates a view in elevation of the body equipped with its winding, with its core and with its armature, sectioned on the broken plane P indicated in FIG. 1, these members being engaged in the body.

As can be seen, in particular in FIG. 2, the casing of the winding which is, here, shown partially sectioned at its right hand side, comprises a lateral extension 53 which carries, on the one hand, a switch 16 and, on the other hand connection terminals such as 17; the switch is intended for example to be operated by the member 12, when the armature 61 is pulled, with a view to putting into operation a current limiting circuit; this switch is advantageously disposed between the turns 62 of the winding and the connection terminals 17 in order to facilitate the placing in position described below.

Figure 3:
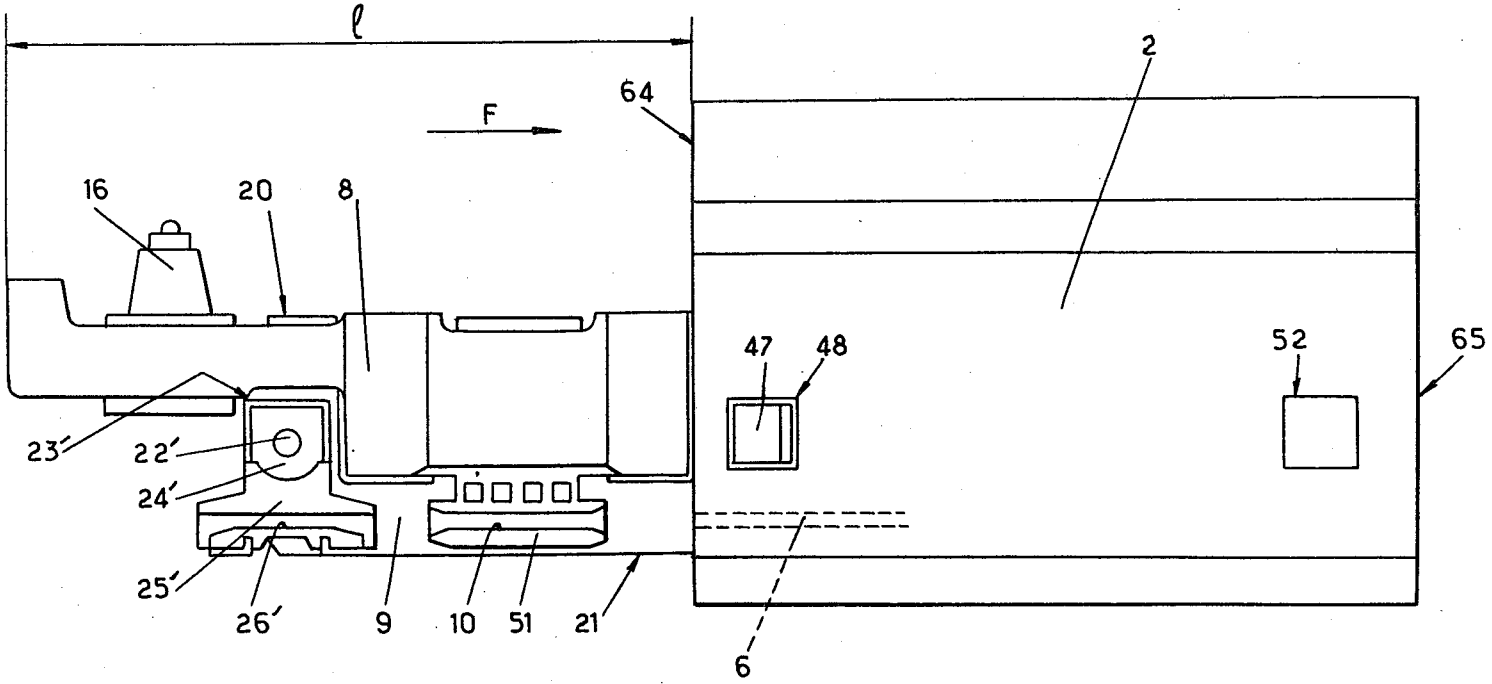
FIG. 3 shows an external view in eleveation of the body, when the fixed elements of the electro-magnet are in position disengaged from the body.

The dissymettry of the envelope of the winding 8, created by the two members 17,16, leads to its putting into position at the interior of the body taking place more easily in the direction of the arrow F, as is likewise visible in FIG. 3.

The core 9 of the electro-magnet is likewise conceived to be guided and supported on the body of the apparatus by the same ribs 6 and 7 which have just been described. For this purpose, the external arms 18 and 20 of a magnetic circuit in the form of an E comprising a central arm and a cross portion 21, are each provided with a pair of runners. The two runners of each pair are placed at each side of the core in order to be able to cooperate with the adjacent ribs.

Figure 4:
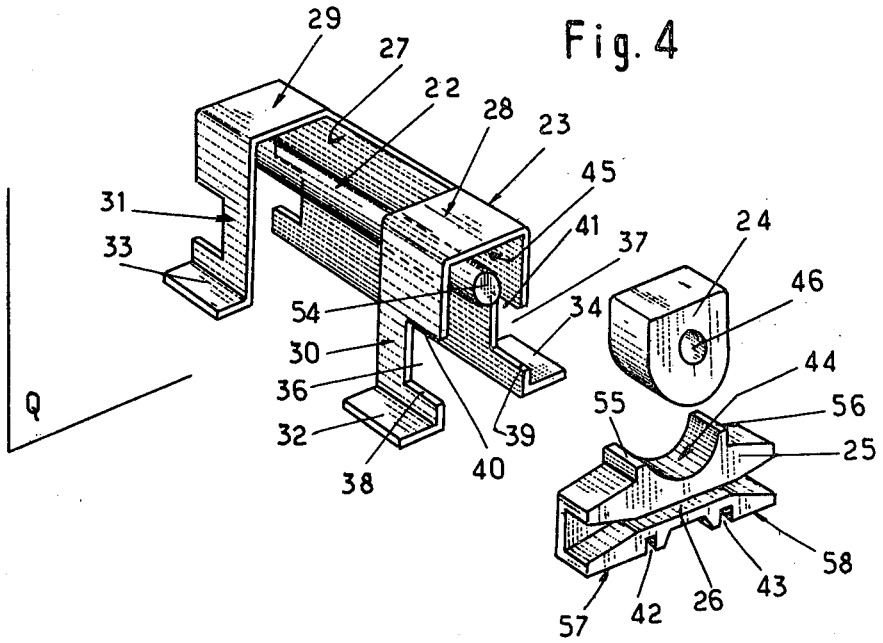
FIG. 4 shows in perspective the members serving to guide and support the core at the interior of the body.

On FIG. 2, the runner 25, placed on the arm 18, cooperates by its groove 26 with the rib 6, not visible because of the sectioning, whilst the runner 25' placed on the branch 20 and visible in FIG. 3 will be caused to cooperate with this same rib, when the core is introduced into the body in the direction of the arrow F. The association between the runners and the arm with which they are associated is better visible in FIGS. 4 and 5.

Referring to this latter, it can be seen that the arm 18 is traversed by a cylindrical pin 22 the extremities such as 54 of which extend beyond the core by a length permitting to thread thereon a resilient block 24 having an opening 46. A metal stirrup 23 visible in particular in FIG. 4 and having, in section, the general shape of an inverted U comprises a first wall 27 and two legs 30,31 parallel to this wall. These legs are coupled to the wall by bent portions 28 and 29 respectively, having an internal surface such as 45 directed towards the base of the figure. Each of the external arms of the core will be encircled by a stirrup, the plane of symmetry of this core being shown here at Q.

At the same side of this plane Q, the wall 27 of the arm 30 has respective recesses 37 and 36 bounded by two upper edges 41 and 40 and two lower edges 39 and 38.

The runner 25 itself comprises two upper shoulders 55 and 56, and two lower notches 42 and 43, these shoulders and notches being disposed at each side of the groove 26 which will be directed towards the ribs.

Between the shoulders 55 and 56 is placed a bearing surface 44.

When the mounting of the members, which have just been described, is carried out (see FIGS. 2,3 and 5), the resilient block 24 becomes compressed between the surfaces 45 of the stirrup 44 and of the runner, and the edges 38,39 are engaged in the notches 42 and 43 respectively.

The different elements thus ensure the resilient suspension of the core and support it with respect to two axes of the runner, the edges 40 and 41 and the shoulders likewise serving to ensure that the plane of the grooves 26 coincides properly with that of the ribs. A light oscillation of the assembly of the stirrup and the runners, which are associated therewith, about the axis of the pin 22 always remains possible and permits the orientation of the groove 26 without necessitating the manufacture of parts having too great mounting tolerances.

When an electro-magnet is to be disposed at the interior of the body, a winding and a core are associated by engagement of the first on the second, as can be seen in FIG. 3, thanks to the dimension 1 by which the assembly can project at the exterior of the body.

The grooves of the runners disposed at the side of the electro-magnet which will engage in the body of the switch are then presented opposite to the ribs, and the assembly is introduced by a movement carried out in the direction of the arrow F.

Figure 5:
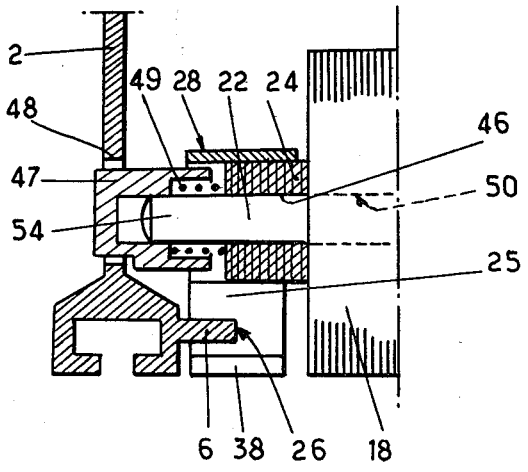
FIG. 5 shows the body in half section on the plane R visible in FIG. 2, at the level of the members for guiding, supporting, and locking of the core at the interior of the body.

In the course of this movement, a bolt 47 visible in FIGS. 5 and 3 wherein it will be seen that it slides resiliently on the end 54 of the pin 22 with compression of a spring 49, moves along the surface 4 of the wall 2, then engages in a first lateral opening 48 formed in this wall, in the region of its end 64, continuation of the movement then leading the bolt 47 into a second lateral opening 52 formed in this wall in the region of its opposite end 65 to positively immobilise the core in a position bringing the poles of its arms opposite to those of the armature. In the course of the movement which has just been described, the runner 25, the slideway 51 and the runner 25' become placed successively opposite to the rib and are engaged on it.

Figure 6:
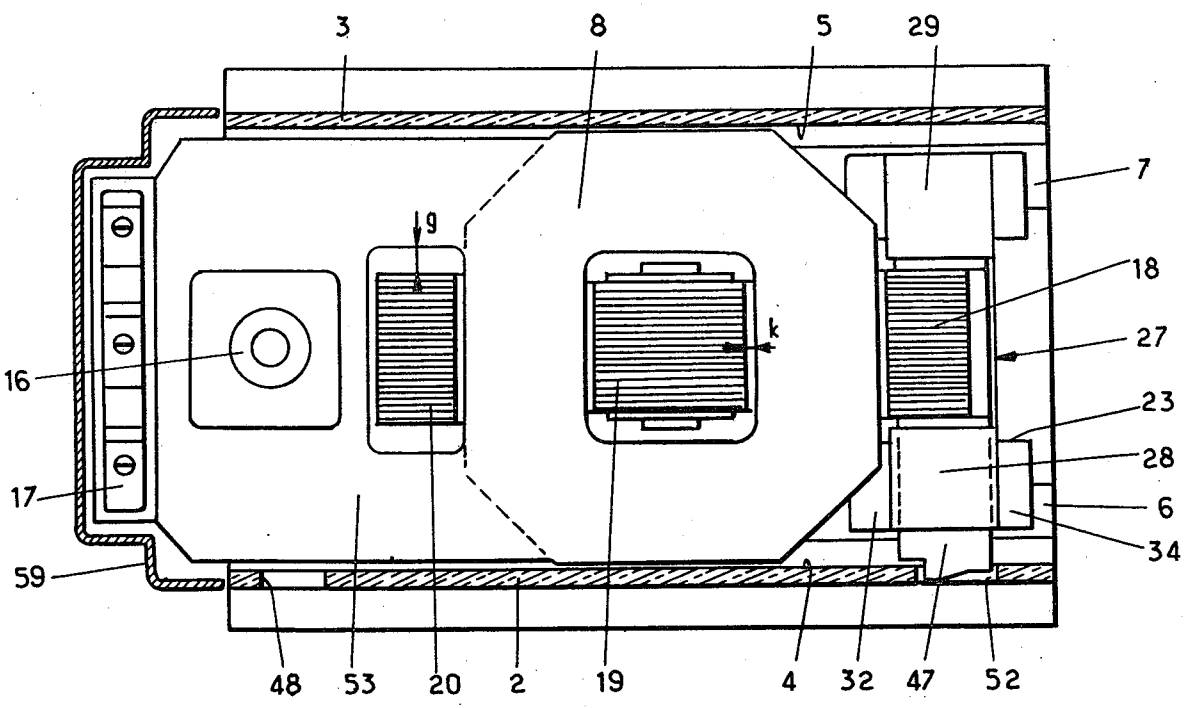
FIG. 6 represents a view from above of the core provided with its winding.

By construction, the casing of the winding does not bear on the core when the guiding elements 26,26' and 10 are engaged on the grooves, such that shocks undergone by the core are not transmitted to the winding, by reason of its own slideways 51,52 disposed between the runners 25,25' . . . as can be seen in FIG. 2 wherein the distances j,k,g measure the spacings separating the casing of the winding and the core (see also FIG. 6).

A lateral cover 59 permits the closing of the body of the switch, and a window 60 of this cover gives access to the connection terminals 17 of the winding.

We claim:

1. In a contactor in which a body is constituted by a common base joined to two parallel shaped metal walls each having on its external face a rib serving to guide and support fixed elements, namely the winding and the core, of a removable electro-magnet having members adapted to cooperate with said ribs and which actuates a movable armature, the improvement which comprises:

(i) said fixed elements, when they are assembled, together constitute a slide of which at least a lateral region has resilient locking means (ii) said locking means cooperate with stop means disposed on an adjacent wall such that, in a first position of cooperation between said locking means and stop means, said core is disposed opposite to said armature, said core being associated with said body by first support means, said winding being made fast to said body by other support means independent of the support means of said core, and in a second position of cooperation between said locking means and said stop means, said core remains engaged with said body and extends externally thereof to such an extent that said winding support means are freed from said rib, and said winding can be separated from said core on which it is placed.

2. A contactor, as claimed in claim 1, wherein said electro-magnet comprises at least two external arms, and wherein four runners constituting said first means each have a respective groove and are connected to said arms by respective resilient means disposed in pairs at each side of a plane of symmetry of said core along which said core moves within said body.

3. A contactor, as claimed in claim 2, wherein said four points are constituted by opposed ends of two pins each passed through a respective one of said external arms.

4. A contactor, as claimed in claim 3, wherein on each said external arm of said core there is a respective U-shaped stirrup, the opening of said stirrup being directed the respective associated runners, and wherein an arm of said stirrup is constituted by a massive wall and the other arm of said stirrup comprises two portions parallel to said first arm and joined thereto by respective corss-pieces, and wherein the ends of said portions and the end of said massive wall form a housing receiving a runner, and wherein, between a bearing surface of said runner opposite to a bearing surface of said stirrup carried by the cross-piece, there is disposed a resilient block having an opening through which is passed the adjacent end of the pin.

5. A contactor, as claimed in claim 1, wherein said wall has in the region of its end two stop openings which cooperate with a bolt carried by said core so as to assure, for said core, its placement in said respective first and second positions.

6. A contactor, as claimed in claim 1, wherein, in said second position, an extension of said winding carrying connection terminals is disposed at the exterior of said body, and wherein an auxiliary contact included in a current-reducing circuit is carried by said extension between said terminals and the turns of said winding.

7. A contactor, as claimed in claim 5, wherein said bolt slides on the end of said pin under the action of a spring concentric with said pin, said spring urging said bolt against the internal face of the wall disposed opposite thereto.

8. A contactor, as claimed in claim 1, wherein said supporting means associated with said winding are slideways each including a respective groove, said support means being disposed said first support means of the core.

* * * * *

UNITED STATES PATENT AND TRADEMARK OFFICE

CERTIFICATE OF CORRECTION

PATENT NO. : 4,253,076

DATED : February 24, 1981

INVENTOR(S) : Jean-Pierre Guery et al.

It is certified that error appears in the above–identified patent and that said Letters Patent are hereby corrected as shown below: On the title page item [73] should read:

-- Assignee: La Telemecanique Electrique France --

Signed and Sealed this

*Twenty-fifth* Day of *June 1985*

[SEAL]

*Attest:*

DONALD J. QUIGG

*Attesting Officer*

*Acting Commissioner of Patents and Trademarks*